US011780697B2

(12) United States Patent
Okawa et al.

(10) Patent No.: US 11,780,697 B2
(45) Date of Patent: Oct. 10, 2023

(54) RECORDING APPARATUS

(71) Applicant: SEIKO EPSON CORPORATION, Tokyo (JP)

(72) Inventors: Soshi Okawa, Shiojiri (JP); Ryoichi Morisawa, Shiojiri (JP); Satoshi Tamai, Matsumoto (JP); Yoshinori Yanagisawa, Shiojiri (JP); Shomaru Kondo, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 235 days.

(21) Appl. No.: 17/034,340

(22) Filed: Sep. 28, 2020

(65) Prior Publication Data

US 2021/0094785 A1 Apr. 1, 2021

(30) Foreign Application Priority Data

Sep. 30, 2019 (JP) ..... 2019-178881

(51) Int. Cl.

| | |
|---|---|
| ***B65H 29/70*** | (2006.01) |
| ***B41J 11/06*** | (2006.01) |
| ***B41J 11/00*** | (2006.01) |
| ***B65H 31/20*** | (2006.01) |

(52) U.S. Cl.

CPC ..... *B65H 29/70* (2013.01); *B41J 11/0005* (2013.01); *B41J 11/06* (2013.01); *B65H 31/20* (2013.01)

(58) Field of Classification Search

CPC ..... B65H 29/70; B65H 31/02; B65H 2405/11151; B65H 2405/1412; B65H 2405/1114; B65H 2402/343

See application file for complete search history.

(56) References Cited

U.S. PATENT DOCUMENTS

| | | | | |
|---|---|---|---|---|
| 10,165,140 | B2 | 12/2018 | Mokuo et al. | |
| 10,272,704 | B2 | 4/2019 | Tamai | |
| 10,498,914 | B2 | 12/2019 | Mokuo et al. | |
| 11,192,391 | B2 * | 12/2021 | Taketsugu | B65H 1/04 |
| 2018/0007221 | A1 * | 1/2018 | Mokuo | B65H 31/02 |
| 2018/0178563 | A1 * | 6/2018 | Tamai | B65H 29/70 |

(Continued)

FOREIGN PATENT DOCUMENTS

| | | |
|---|---|---|
| JP | H09-278261 | 10/1997 |
| JP | 2018-002370 | 1/2018 |
| JP | 2018-104195 | 7/2018 |

*Primary Examiner* — Howard J Sanders

(74) *Attorney, Agent, or Firm* — WORKMAN NYDEGGER

(57) ABSTRACT

A recording apparatus includes: an output tray into which the paper sheet on which recording has been performed is outputted, wherein the output tray has a rib—includes a pair of first ribs disposed at an upstream position, the pair of first ribs being elongated in an output direction and protruding, and a pair of second ribs disposed at a downstream position, the pair of second ribs being elongated in the output direction and protruding, the output tray has an upstanding end portion (edge receiving section) formed at a downstream end in the output direction, the second rib is formed to be continuous from the edge receiving section, and each of the pair of first ribs and the pair of second ribs are symmetrically arranged to a center (center line) in a width direction, which is perpendicular to the output direction of the paper sheet.

3 Claims, 7 Drawing Sheets

(56) References Cited

U.S. PATENT DOCUMENTS

| | | | | |
|---|---|---|---|---|
| 2019/0089853 | A1 | 3/2019 | Mokuo et al. | |
| 2019/0144229 | A1* | 5/2019 | Ito | B65H 29/14<br>271/208 |

* cited by examiner

RECORDING APPARATUS

The present application is based on, and claims priority from JP Application Serial Number 2019-178881, filed Sep. 30, 2019, the disclosure of which is hereby incorporated by reference herein in its entirety.

BACKGROUND

1. Technical Field

The present disclosure relates to recording apparatuses.

2. Related Art

There have been known recording apparatuses such as printers that perform recording by ejecting liquid onto a medium. In such recording apparatuses, a medium on which recording has been performed is outputted into an output tray. The medium on which recording has been performed swells with the liquid and curls. Thus, the medium having curling is outputted into the output tray. In successive printing and output, if the curling of the previously outputted medium is not removed, the previously outputted medium will be pushed by the subsequently outputted medium having curling and expelled from the output tray. In order to overcome such a situation, JP-A-H9-278261 discloses a sheet output tray (output tray) having a plurality of convex and concave ribs on a surface of the output tray to remove curling.

However, some of the plurality of ribs disclosed in JP-A-H9-278261 do not contribute to correction of curling. In recent years, as the printing speed has been improved, and high duty printing has been performed, the degree of curl tends to increase, and curling may not be corrected simply by providing ribs. Therefore, there has been an increasing demand for providing ribs taking into account the size of the medium and the state of curling so that curling can be effectively removed, and thus the stackability in the output tray can be improved.

SUMMARY

A recording apparatus includes: a recording head that performs recording by ejecting liquid onto a medium; and an output tray into which the medium on which recording has been performed is outputted, wherein the output tray has a rib that receives the outputted medium, the rib includes a pair of first ribs disposed at an upstream position, the pair of first ribs being elongated in an output direction and protruding in a convex shape, and a pair of second ribs disposed at a downstream position, the pair of second ribs being elongated in the output direction and protruding in a convex shape, the output tray has an upstanding end portion formed at a downstream end in the output direction, the second rib is formed to be continuous from the end portion, and each of the pair of first ribs and the pair of second ribs are symmetrically arranged to a center in a width direction, which is perpendicular to the output direction of the medium.

In the above recording apparatus, an inclined surface may be formed on an inner surface of the end portion, the pair of second ribs may extend from an upstream position relative to the inclined surface to the end portion located downstream relative to the inclined surface, and the symmetrical pair of second ribs may have outer side surfaces in the width direction, the outer side surfaces extending vertically.

In the above recording apparatus, the output tray may include a first receiving section, and a second receiving section that can be extended from the first receiving section, and the pair of first ribs may be formed in the first receiving section, and the pair of second ribs and the inclined surface may be formed in the second receiving section.

In the above recording apparatus, the second receiving section may have a pair of third ribs that extend from an upstream position to the inclined surface, the pair of third ribs being elongated in the output direction and protruding in a convex shape, and the pair of third ribs may be symmetrically arranged to a center in a width direction of the medium outputted, and each of the pair of third ribs may have an inclined surface on an upstream end.

In the above recording apparatus, the pair of third ribs may be respectively inserted inside the pair of first ribs when the second receiving section is housed in the first receiving section.

In the above recording apparatus, any one of the pair of first ribs, the pair of second ribs, and the pair of third ribs may be vertically movable.

DESCRIPTION OF EXEMPLARY EMBODIMENTS

1. Embodiment

Figure 1:
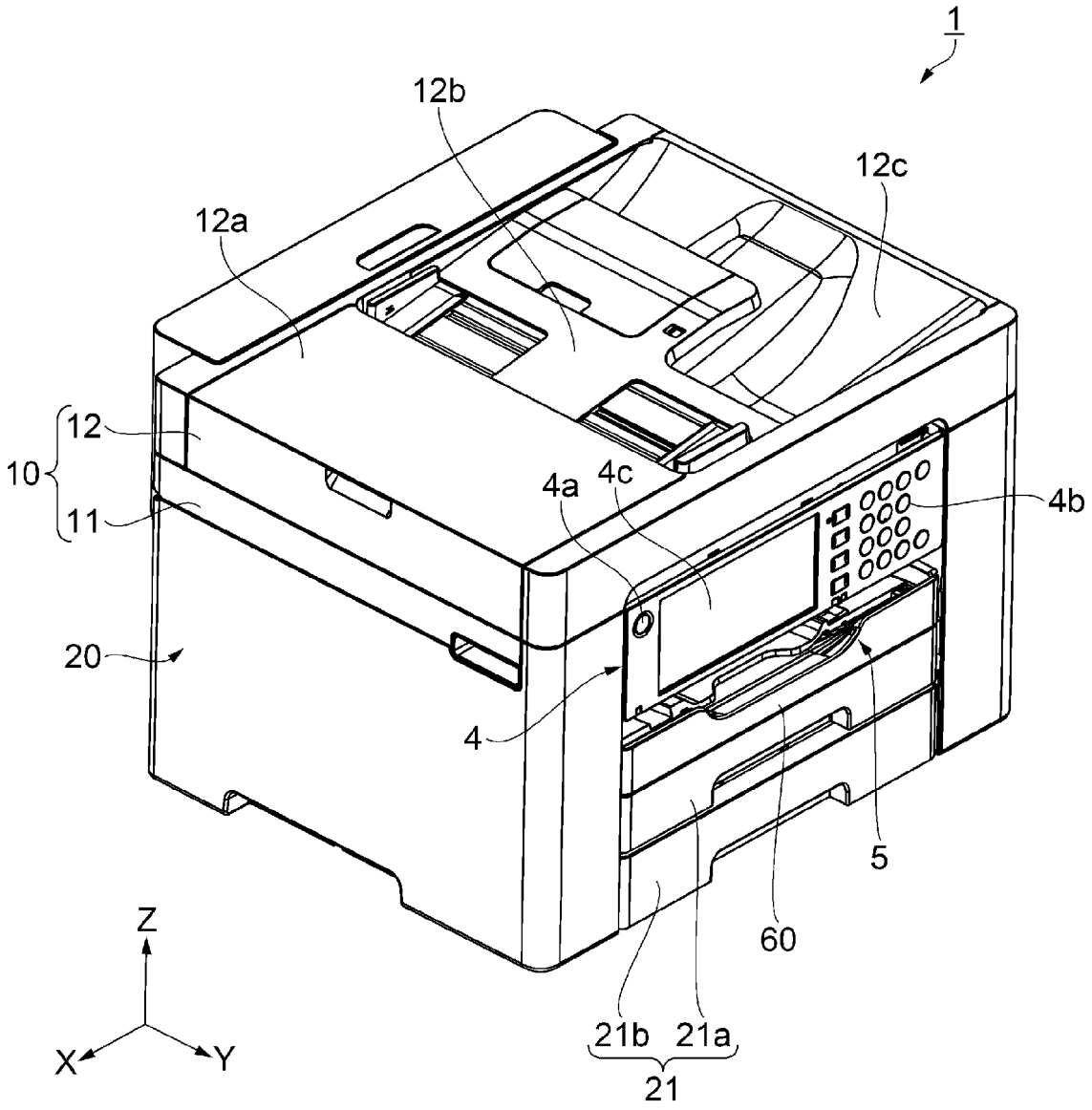
FIG. 1 is a perspective view illustrating a recording apparatus according to the present embodiment.
Figure 2:
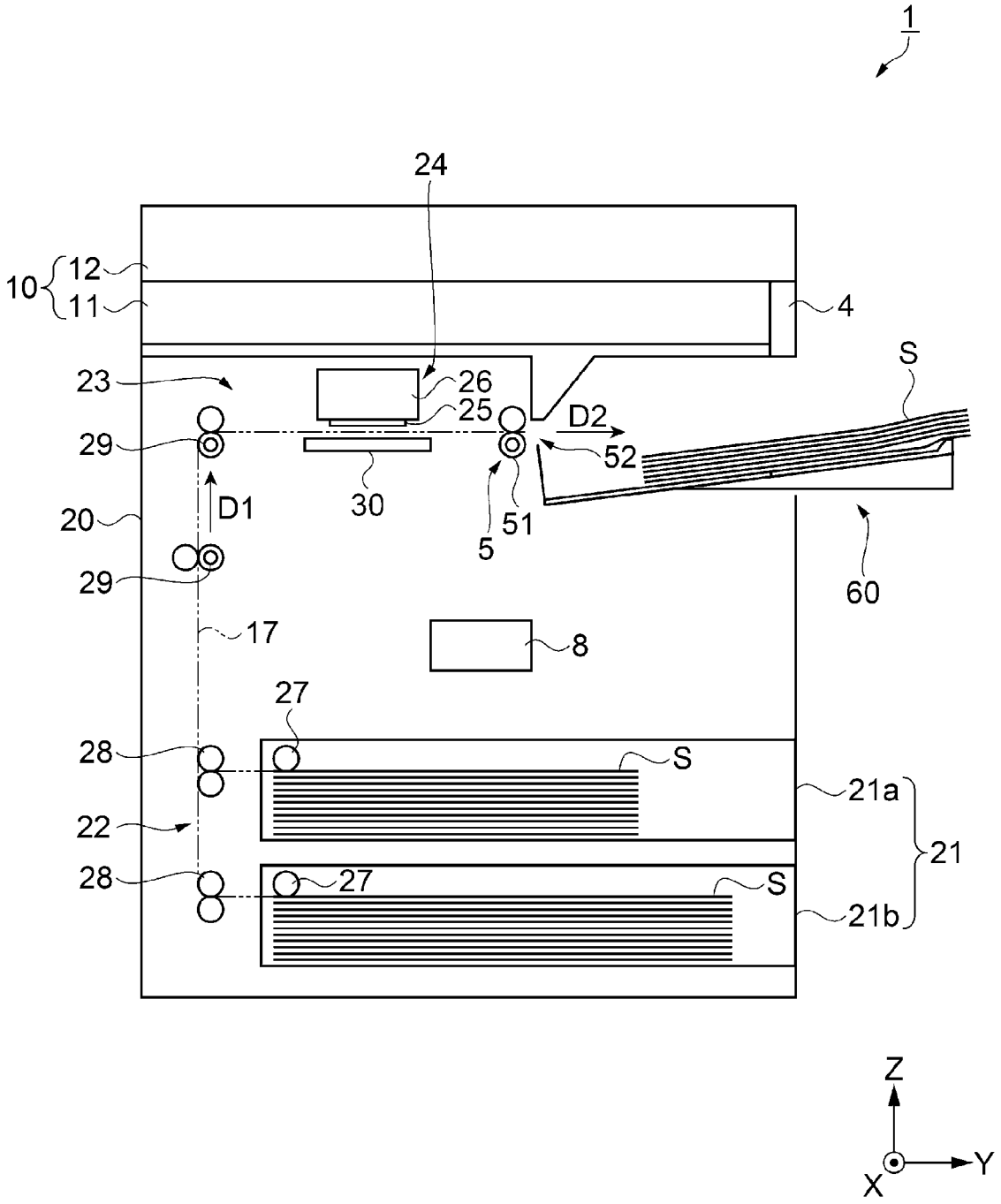
FIG. 2 is a cross-sectional view of a schematic configuration of the recording apparatus.

The outline of a recording apparatus according to the present embodiment will be described. As an example of the recording apparatus, an ink jet recording apparatus (hereinafter, referred to as a recording apparatus 1) will be described. FIG. 1 is a perspective view illustrating the recording apparatus 1 according to the present embodiment. FIG. 2 is a cross-sectional view of a schematic configuration of the recording apparatus 1.

For convenience of explanation, the XYZ coordinate system is used to describe the recording apparatus 1 placed on a horizontal plane. Specifically, the left-right direction of the recording apparatus 1 is taken as an X direction. When viewed in the direction facing the recording apparatus 1 (the surface on which an operation unit 4 is provided), the left direction or left side is defined as a +X direction, whereas the right direction or right side is defined as a −X direction. The front-back direction of the recording apparatus 1, which is horizontal and perpendicular to the X direction, is defined as a Y direction, in which a front direction, front side, or front surface side is defined as a +Y direction, and a rear direction, rear side, or rear surface side is defined as a −Y direction.

Further, a direction perpendicular to the X direction and the Y direction of the recording apparatus 1, in other words, a direction vertical to the horizontal surface is defined as the Z direction, in which an up direction or upper side is defined as a +Z direction, and a down direction (gravitational direction) or lower side is defined as a −Z direction. The directions defined as described above are appropriately used in the following description. The X direction is a width direction of a paper sheet S as a medium, which is a scan direction of a recording head 25. Further, the Y direction is a depth direction of the recording apparatus 1, which is a longitudinal direction of the paper sheet S.

With reference to FIGS. 1 and 2, the outline of the recording apparatus 1 will be described. As shown in FIG. 1, the recording apparatus 1 of the present embodiment is configured as a multifunction machine that includes a recording unit 20 and a scanner unit 10 disposed on the upper side of the recording unit 20.

The scanner unit 10 includes a first reading apparatus 11 and a second reading apparatus 12 disposed on the upper side of the first reading apparatus 11. The first reading apparatus 11 is a flat-bed scanner, and includes a contact image sensor (not shown). When the user opens the second reading apparatus 12 from the first reading apparatus 11, a top surface of the first reading apparatus 11, which is a document placement surface (not shown), is exposed. After a document to be read is placed on the exposed document placement surface of the first reading apparatus 11, the second reading apparatus 12 is closed. Then, a predetermined switch operation is performed via the operation unit 4. Thus, the first reading apparatus 11 can read the characters, symbols, drawings, and the like on the document placed on the document placement surface as an image, and convert the image into an image data.

The second reading apparatus 12 includes a document feeding unit 12*a*. The document feeding unit 12*a* supplies the document placed on a document loading tray 12*b* into the second reading apparatus 12. The second reading apparatus 12, which includes an auto document feeder (ADF), reads the supplied document as an image and then outputs the read document onto a document output tray 12*c*.

The front surface of the recording apparatus 1 is provided with the operation unit 4 through which the recording apparatus 1 is operated. The operation unit 4 is a horizontally elongated panel extending in the X direction, and includes a power button 4*a* that is operated for turning on and off the recording apparatus 1, an operation button 4*b* that is used in input of various operation information, and a display panel 4*c* that displays an operation state and the like. The display panel 4*c* is, for example, a liquid crystal panel.

As shown in FIG. 2, the recording unit 20 has a transport path 17 indicated by the double dotted and dashed line, and the paper sheet S is transported in a transport direction D1. The recording unit 20 includes a paper sheet cassette 21, a feed unit 22, a transport unit 23, a recording unit 24, an output unit 5, a control unit 8 and the like incorporated therein.

The paper sheet cassette 21 is detachably provided in a lower part of the recording apparatus 1. The paper sheet cassette 21 is an accommodating section configured to accommodate a stack of the paper sheets S. In the present embodiment, the paper sheet cassette 21 includes a paper sheet cassette 21*a* for accommodating A4 size paper sheets S, and a paper sheet cassette 21*b* for accommodating A3 size paper sheets S.

The feed unit 22 feeds the paper sheet S from the paper sheet cassette 21 to the transport unit 23. The feed unit 22 includes pick-up rollers 27 for feeding out the uppermost paper sheet S from a stack of paper sheets S accommodated in the paper sheet cassette 21, and separation roller pairs 28 for separating the paper sheets S one by one that have been supplied from the pick-up roller 27. Further, the feed unit 22 includes a feed motor (not shown) for rotating the pick-up roller 27. When the pick-up roller 27 and the separation roller pair 28 corresponding to each of the paper sheet cassettes 21*a* and 21*b* which accommodate the stack of paper sheets S to be used for recording (printing) are driven, the paper sheet S to be used for recording is transported to the transport unit 23.

The transport unit 23 transports the paper sheet S that has been supplied thereto to the recording unit 24. The transport unit 23 includes a transport roller pair 29 that is driven to rotate by the transport motor (not shown), and transports the paper sheet S along the transport path 17. Further, a platen 30 is disposed at a position facing the recording unit 24 on the transport path 17. The paper sheet S is transported while being attracted to a support surface (top surface) of the platen 30.

The recording unit 24 includes the recording head 25 that ejects ink as liquid onto the paper sheet S, a carriage 26 that supports the recording head 25 and is movable in a width direction (X direction) perpendicular to the transport direction D1 (+Y direction) of the paper sheet S, and an ink cartridge (not shown) that supplies ink to the recording head 25. The recording head 25 is provided at a position facing the platen 30 with the transport path 17 therebetween.

The recording unit 24 performs recording (printing) by ejecting ink according to the recording data (print data) onto the paper sheet S that has been transported while being supported by the platen 30 to adhere the ink and form an image according to the recording data. The recording data is the data based on which the recording apparatus 1 performs recording, and is generated based on the data of texts and images to be recorded on the paper sheet S. Further, after the recording is performed, the paper sheet S is transported by the transport unit 23 into the output unit 5, which is located downstream from the recording head 25 in the transport direction D1.

The output unit 5 outputs the paper sheet S, on which recording has been performed, from an output port 52 by an output roller pair 51 in the output direction D2 into an output tray 60. When the paper sheets S are successively recorded and outputted, the outputted paper sheets S are sequentially stacked on the previously outputted paper sheet S.

The control unit 8 controls driving of the feed unit 22, the transport unit 23, the recording unit 24, the output unit 5, and the like. The control unit 8 further cooperates with a scanner control unit (not shown) provided in the scanner unit 10 to perform overall control as the recording apparatus 1.

Figure 3:
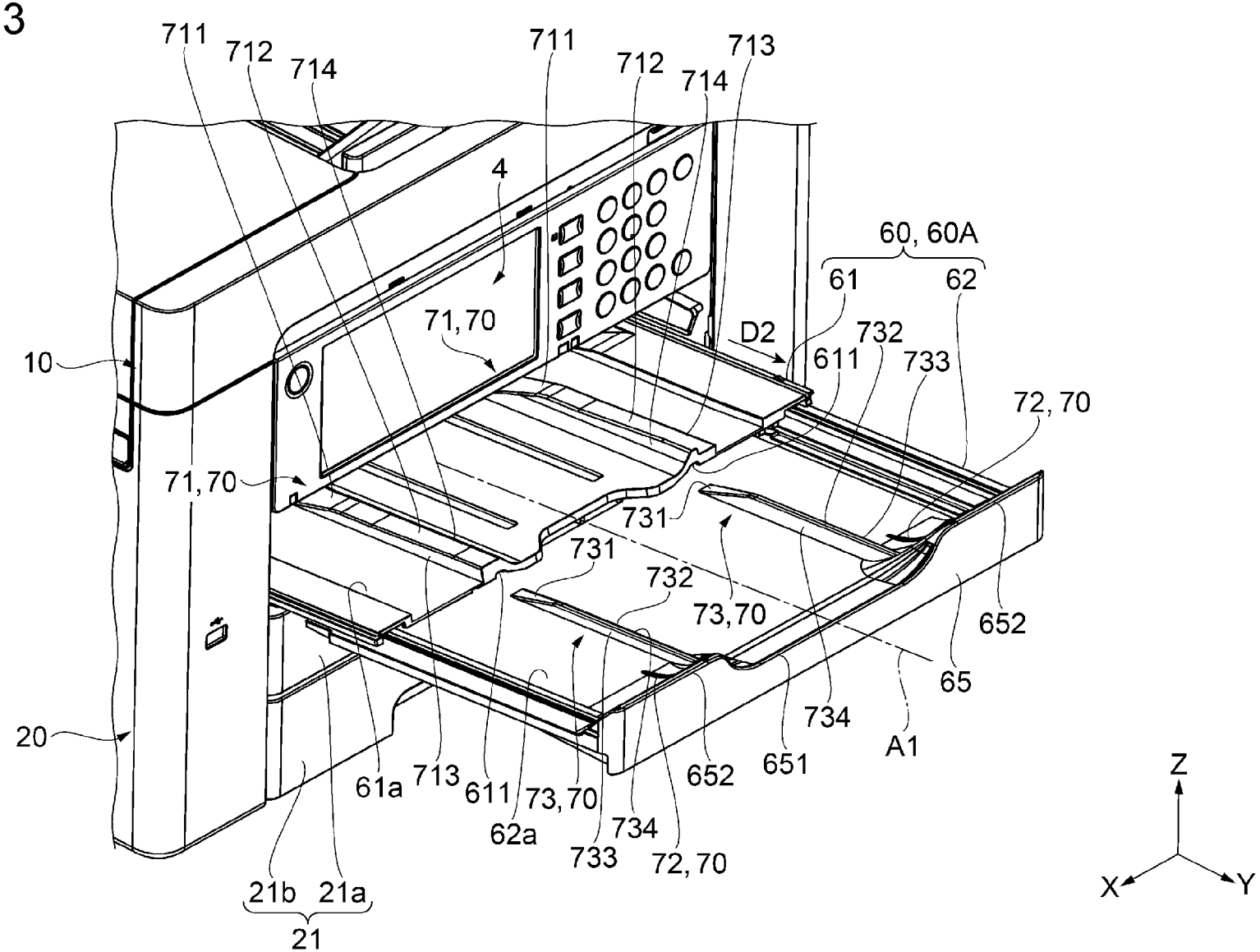
FIG. 3 is a perspective view of a configuration of an output tray.
Figure 4:
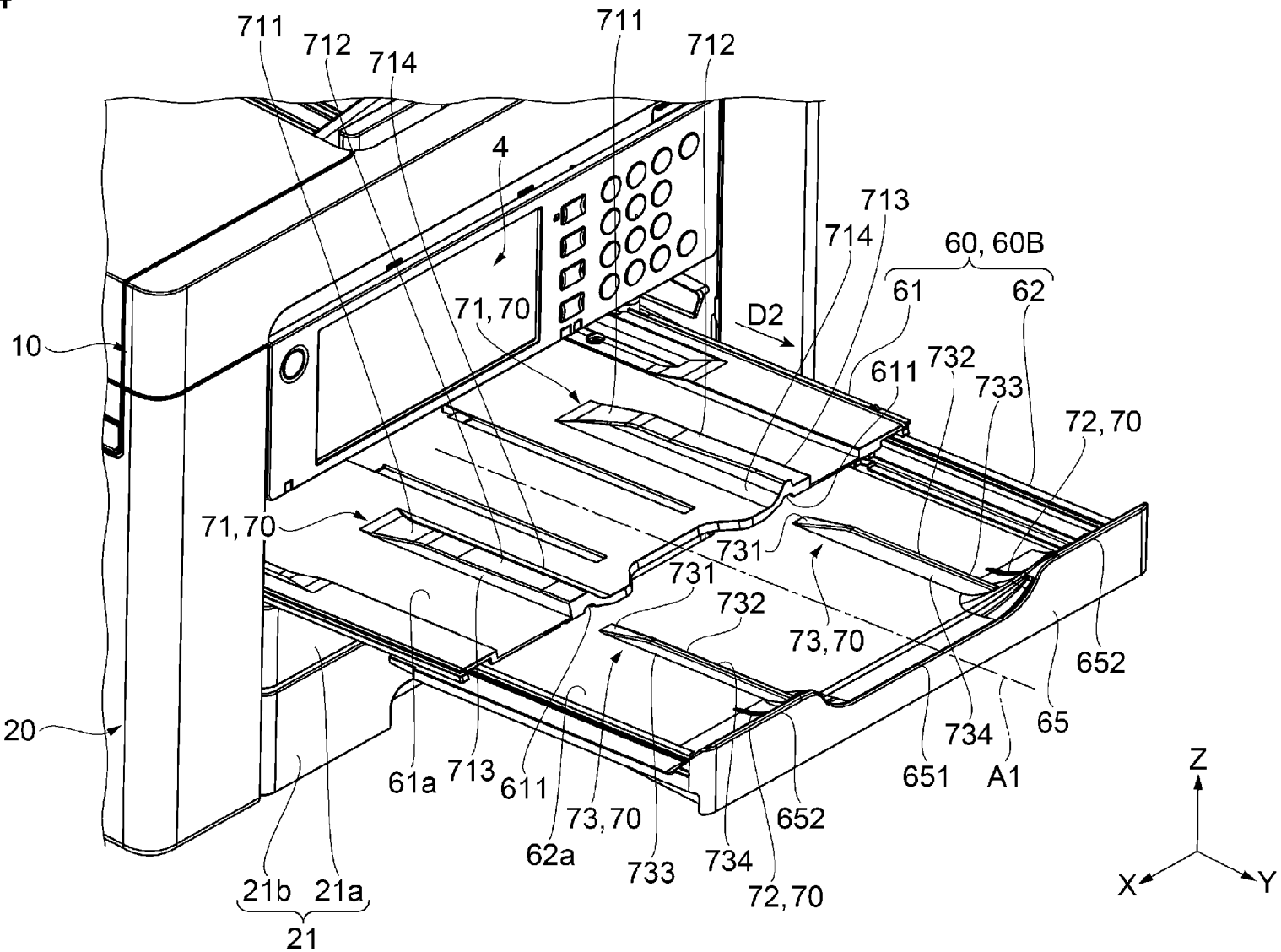
FIG. 4 is a perspective view of a configuration of an output tray.

FIGS. 3 and 4 are perspective views illustrating a configuration of the output tray 60. Specifically, FIG. 3 is a perspective view illustrating the output tray 60 for outputting A4 size paper sheets S, and FIG. 4 is a perspective view illustrating the output tray 60 for outputting A3 size paper sheets S.

According to the output tray 60 of the present embodiment, the extension amount of the output tray 60 varies depending on the size of the paper sheet S (A4 size, A3 size). Specifically, a first receiving section 61, described later, has different extension amount. Therefore, the state of the output tray 60 for A4 size shown in FIG. 3 is referred to as an output tray 60A. Further, the state of the output tray 60 for A3 size shown in FIG. 4 is referred to as an output tray 60B. The output tray 60A and the output tray 60B are collectively referred to as the output tray 60.

As shown in FIGS. 3 and 4, the output tray 60 includes the first receiving section 61 located upstream in the output direction D2, and a second receiving section 62 that can be extended from the first receiving section 61. When not in use, the output tray 60 can be housed in the recording unit 20 as shown in FIG. 1.

When the output tray 60 is housed, the second receiving section 62 overlaps the underside of the first receiving section 61. When in use, the output tray 60 is expanded by a control unit 8 and a drive motor (not shown) into the state of the output tray 60A shown in FIG. 3 or the state of the output tray 60B shown in FIG. 4 corresponding to the size of the paper sheet S to be recorded. The direction in which the output tray 60 is expanded is set to be slightly upward rather than the horizontal direction. This reduces the momentum of the outputted paper sheet S.

With reference to FIG. 3, the case where the output tray 60 is expanded to the state of the output tray 60A is described. In the output tray 60, the first receiving section 61 and the second receiving section 62 each have a rack (not shown) on one end in the width direction. The rack meshes with a pinion (not shown) that transmits power of the drive motor.

When recording is performed, the drive motor is driven by an instruction from the control unit 8. As the pinion is driven to rotate by the drive motor, the rack that meshes with the pinion moves to cause the second receiving section 62 to be first extended downstream in the output direction D2 from the first receiving section 61. After the second receiving section 62 is extended to the maximum from the first receiving section 61, the first receiving section 61 is extended downstream in the output direction D2 in the same manner as the second receiving section 62 from the housing position while supporting the second receiving section 62 that has been extended to the maximum.

The output tray 60A corresponds to the A4 size paper sheets S. In the present embodiment, the outputted paper sheet S stops moving in the state in which the downstream edge of the paper sheet S in the longitudinal direction has moved beyond an edge receiving section 65, described later, to some extent (see FIG. 2). The edge receiving section 65 is a downstream end of the second receiving section 62 in the output direction D2. The first receiving section 61 is extended downstream in the output direction D2 from the housing position by a corresponding extension amount.

With reference to FIG. 4, the case where the output tray 60 is expanded to the state of the output tray 60B is described. The output tray 60B is in a state in which the A3 size paper sheets S are outputted. In the present embodiment, the A3 size paper sheet S outputted to the output tray 60B stops moving in the state in which the downstream edge of the paper sheet S in the longitudinal direction has moved beyond the edge receiving section 65 in the second receiving section 62 to some extent (see FIG. 2) as with the A4 size paper sheet S.

When recording is performed to the A3 size paper sheet S, the output tray 60B is set such that the second receiving section 62 is extended to the maximum from the first receiving section 61 as with the case of the output tray 60A. On the other hand, the extension amount of the first receiving section 61 in the output tray 60B is larger than that in the output tray 60A. The reason for this is that the length of A3 size paper sheets S is longer than the length of A4 size paper sheets S, for the extension amount is set depending on the difference in length between the A4 size paper sheets S and the A3 size paper sheets S.

The output tray 60 extending from the recording unit 20 can be inserted into the recording unit 20 automatically or manually. When the output tray 60 is manually inserted, specifically, the user holds the edge receiving section 65 with both hands and pushes it into a direction opposite to the output direction D2. The recording unit 20 has a ratchet mechanism (not shown) in the output unit 5. Therefore, when a force of a predetermined amount or more is applied to the pinion by the user pushing the edge receiving section 65, the ratchet mechanism operates to cause the pinion to rotate in the reverse direction so that the second receiving section 62 is housed under the first receiving section 61. Subsequently, the first receiving section 61, which supports the second receiving section 62 on the underside, moves to the housing position inside the recording unit 20. Thus, the output tray 60 can be housed in the recording unit.

Next, the configuration of the output tray 60 will be described. As described above, the output tray 60 is composed of the first receiving section 61 and the second receiving section 62. As shown in FIGS. 3 and 4, the first receiving section 61 includes a pair of first ribs 71 that form a rib 70. The first rib 71 extends in the output direction D2, and protrudes in a convex shape from the top surface 61*a*.

The pair of first ribs 71 are symmetrically arranged to the center in the width direction, which is perpendicular to the output direction D2 of the paper sheet S. Further, in the present embodiment, a virtual center line μl, which is the center in the paper width direction of the sheet S, is indicated by the dotted and dashed line. In the present embodiment, the paper sheets S used for recording are A4 and A3 size paper sheets S, and the center line in the width direction of the A4 and A3 size paper sheets S substantially corresponds to the center line μl.

The first rib 71 is composed of an inclined surface 711, a flat surface 712, an outer side surface 713, and an inner side surface 714. The inclined surface 711 is an upstream part of the first rib 71 and gradually rises from the top surface 61*a*. The flat surface 712 extends from a downstream end of the inclined surface 711 to a downstream end of the first receiving section 61 at a predetermined height.

The outer side surfaces 713 in the width direction of the symmetrical pair of first ribs 71 are each perpendicular to the top surface 61*a*. Further, the inner side surfaces 714 in the width direction of the pair of first ribs 71 are each gently inclined. In addition, a distance between the outer side surfaces 713 of the pair of first ribs 71 is set to be shorter than the width dimension of the A4 size paper sheet S.

Figure 5:
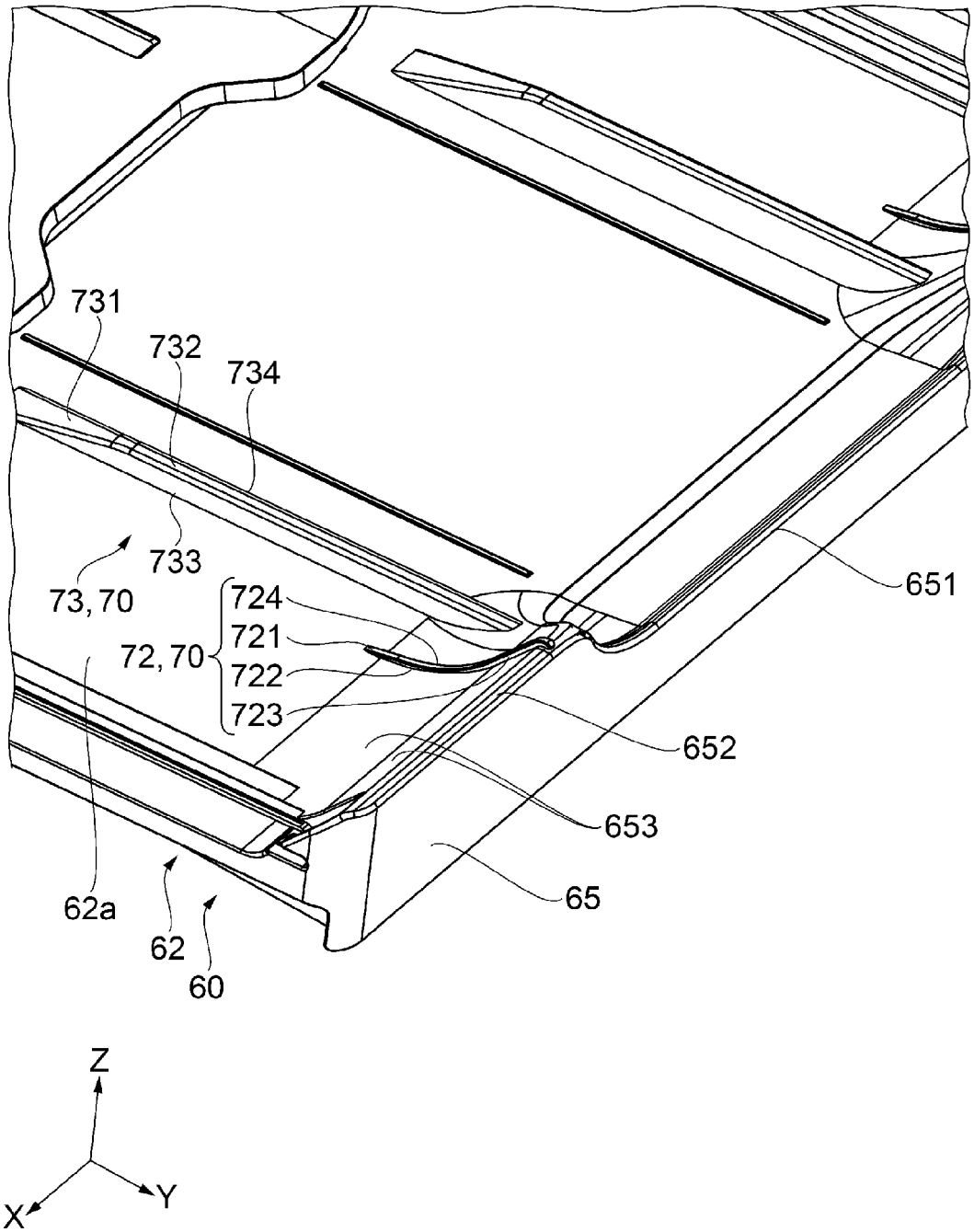
FIG. 5 is a perspective view of a configuration of a second rib.
Figure 6:
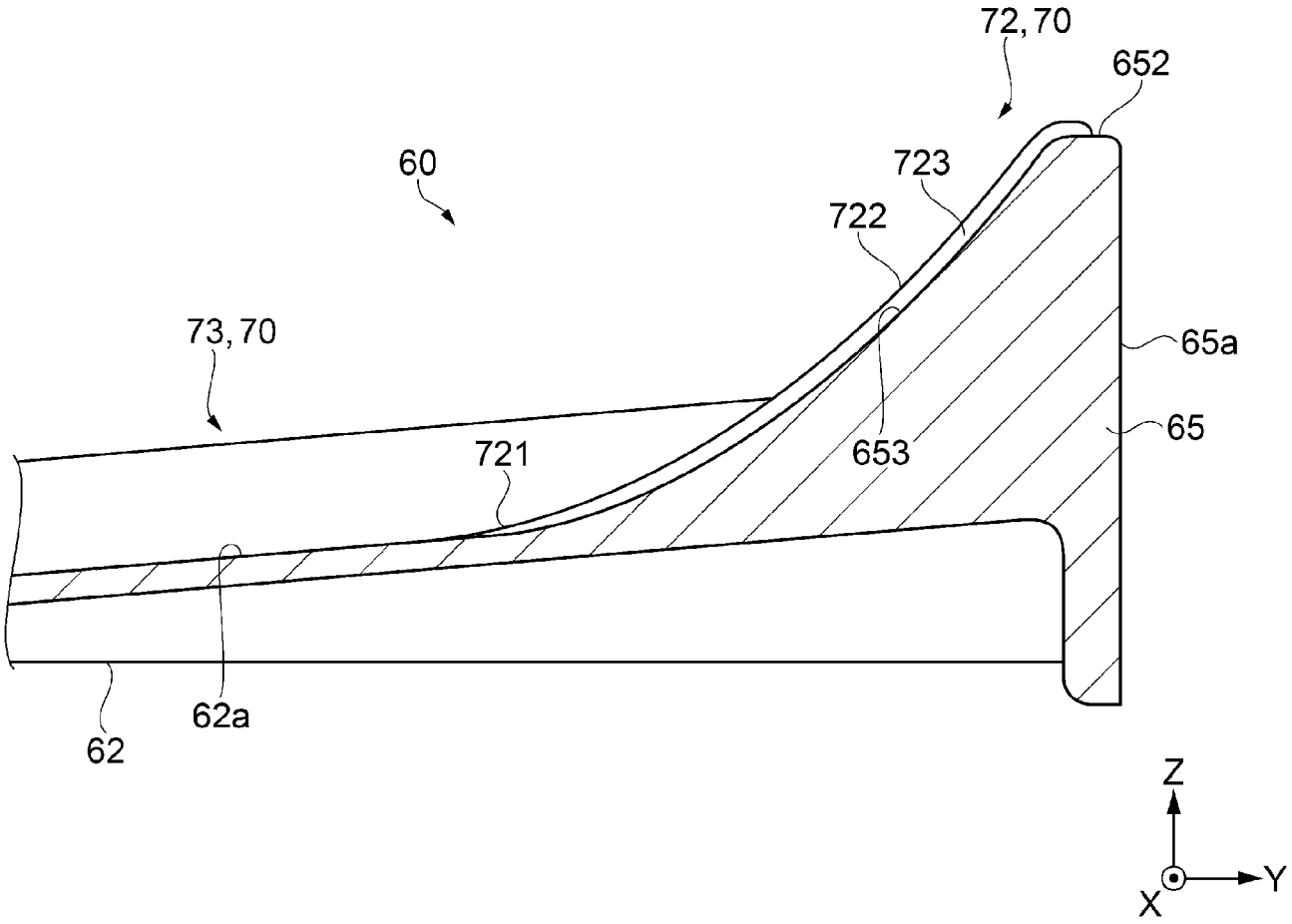
FIG. 6 is a schematic cross-sectional view of a configuration of a second rib.

FIG. 5 is a perspective view of a configuration of the second rib 72. FIG. 6 is a schematic cross-sectional view of a configuration of the second rib 72. As shown in FIGS. 3 to 6, the second receiving section 62 is housed under the first receiving section 61, and supported on the underside of the first receiving section 61 even when extended. Further, the downstream end of the second receiving section 62 in the output direction D2 is formed as the edge receiving section 65, which is vertically upstanding and constitutes the outer surface of the output tray 60 as the recording unit 20. A notch 651 is formed at the center of the edge receiving section 65 in the width direction. The notch 651 is used, for example, for hooking a finger when the output tray 60 is housed.

In the edge receiving section 65, which is a downstream end of the output tray 60 in the output direction D2, an inclined surface 653 is formed on the inner surface, which is an upstream part of the edge receiving section 65. The inclined surface 653 is inclined from an upper end portion 652, which is an end in the width direction of the edge receiving section 65, toward the top surface 62*a*. Specifically, an upstream part of the inclined surface 653 has an inner curved surface, while a downstream part has a uniform inclined angle and has an outer curved shape at the end portion 652.

The second receiving section 62 includes a pair of second ribs 72 that form a rib 70. The second rib 72 extends in the output direction D2, and protrudes in a convex shape from the top surface 62*a* of the second receiving section 62. The second rib 72 is formed to be continuous from the top surface 62*a*, which is located upstream from the inclined surface 653, to the end portion 652, which is located downstream from the inclined surface 653. As with the pair of first ribs 71, the pair of second ribs 72 are symmetrically arranged to the center in the width direction (center line μl), which is perpendicular to the output direction D2 of the paper sheet S.

The second rib 72 is composed of an inclined surface 721, an inclined surface 722, an outer side surface 723, and an inner side surface 724. The inclined surface 721 is gradually rises from the upstream top surface 62*a*. The inclined surface 722 extends from a downstream end of the inclined surface 721 to the end portion 652 of the edge receiving section 65 at a predetermined height along the surface shape of the inclined surface 653. Further, in the present embodiment, the inclined surface 722 extends to an inner side of the end portion 652 of the edge receiving section 65, and does not reach the outer surface 65*a* (see FIG. 6) of the edge receiving section 65.

The outer side surfaces 723 in the width direction of the pair of second ribs 72 are each perpendicular to the top surface 62*a*. Further, the inner side surfaces 724 in the width direction of the pair of second ribs 72 are each perpendicular to the top surface 62*a*. In addition, as with the distance between the outer side surfaces 713 of the pair of first ribs 71, a distance between the outer side surfaces 723 of the pair of second ribs 72 is set to be shorter than the width dimension of the A4 size paper sheet S.

The output tray 60 of the present embodiment is composed of the upstream first receiving section 61 and the downstream second receiving section 62. The first rib 71 is formed in the first receiving section 61, and the second rib 72 is formed in the second receiving section 62. When taken as a single output tray 60, the first rib 71 is located upstream in the output tray 60, and the second rib 72 is located downstream in the output tray 60.

The first rib 71 and the second rib 72 are mainly used for removing curling of the A4 size paper sheets S. In the following description, curling that occurs in recording of the A4 size paper sheets S will be described.

In the present embodiment, the recording surface (printing surface) of the paper sheet S is on the top side. Accordingly, when ink is ejected from the above onto the paper sheet S, the top side swells, and the paper sheet S tends to curl with the convex side on the top side. This state of curling is hereinafter referred to as "downward curl." Further, when the paper sheet S is of A4 size, the outputted paper sheet S tends to curl in the width direction while curling downward. This state of curling is hereinafter referred to as "cross-direction curl." The cross-direction curl is curling substantially symmetrical to the center in the width direction of the paper sheet S. Further, the center of the paper sheet S having the cross-direction curl corresponds to the center line μl in the output tray 60 when the paper sheet S is outputted.

Figure 7:
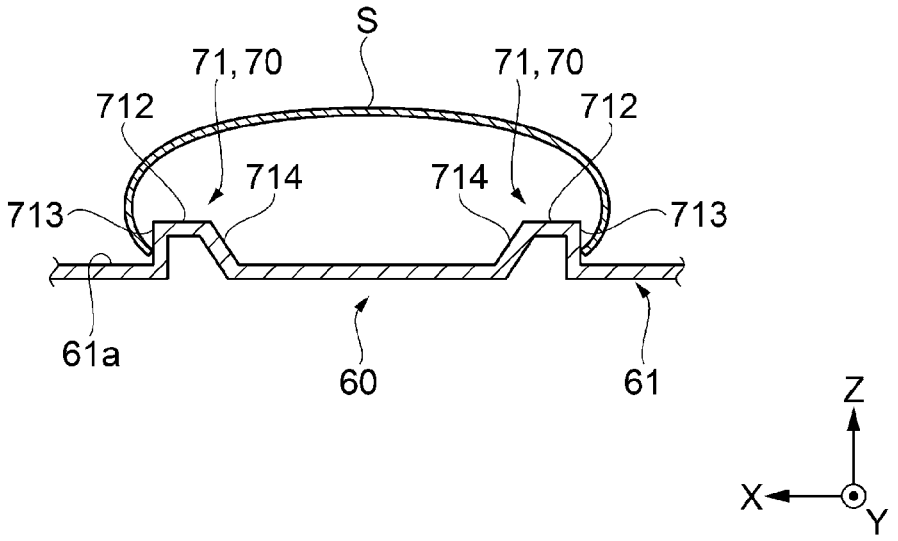
FIG. 7 is a cross-sectional view illustrating how first ribs remove cross-direction curl of an A4 size paper sheet.

FIG. 7 is a cross-sectional view illustrating how the first ribs 71 remove the cross-direction curl of the A4 size paper sheet S. As shown in FIG. 7, in the pair of first ribs 71, when the A4 size paper sheet S having the cross-direction curl is outputted, both ends of the paper sheet S in the width direction are respectively in sliding contact with the outer side surfaces 713 each formed of a vertical surface.

The pair of first ribs 71 are symmetrically formed to the center line μl of the paper sheet S, and both ends of the outputted paper sheet S in the width direction are in contact with the respective outer side surfaces 713 in a substantially symmetrical manner. Accordingly, the cross-direction curl is removed by this output state of the paper sheet S and the first ribs 71. Further, since the outer side surfaces 713 of the present embodiment are each formed of a vertical surface, both ends of the paper sheet S in the width direction can be reliably caught by the outer side surfaces 713 compared with the case where they are formed of an inclined surface inclined toward the top surface 61*a*.

In the pair of second ribs 72 as well, when the A4 size paper sheet S having the cross-direction curl is outputted, both ends of the paper sheet S in the width direction are respectively in sliding contact with the outer side surfaces 723 each formed of a vertical surface in a substantially symmetrical manner. Accordingly, the cross-direction curl is removed in the same manner as by the first ribs 71. In particular, since the pair of second ribs 72 are formed to extend along the inclined surface 653 of the edge receiving section 65 to the downstream end portion 652, both ends of the paper sheet S can be guided to the most downstream position in the output tray 60A to thereby further remove the cross-direction curl of the paper sheet S.

In the present embodiment, a distance between the outer side surfaces 723 of the pair of second ribs 72 is set to be larger (wider) than a distance between the outer side surfaces 713 of the pair of first ribs 71. As the paper sheet S whose curl is removed by the first ribs 71 is in contact with the top surface 62*a*, which is originally slant to the horizontal surface, and the inclined surface 653 of the edge receiving section 65, both ends of the paper sheet S become slightly spread outward in the width direction. The ends thus spread are received by the second ribs 72. Further, when the paper sheet S is in sliding contact with the outer side surfaces 723, curling is further removed, and the height of the paper sheet S can be further reduced.

If the degree of removal of the cross-direction curl is low, the height of the paper sheet S from the top surfaces 61*a* and 62*a* of the output tray 60 increases. As a consequence, the first outputted paper sheet S interferes with the second and subsequently outputted paper sheets S, and is pushed out. However, since the second ribs 72 contribute to further removal of the cross-direction curl and further reduction in the height of the paper sheet S, the problem that the first outputted paper sheet S is pushed out can be prevented. Moreover, the outputted A4 size paper sheet S undergoes resistance from the inclined surface 653 in the second receiving section 62, which lowers the output speed, and stops moving at a position beyond the edge receiving section 65 as shown in FIG. 2.

By this operation, the first outputted paper sheet S with the cross-direction curl and the height being reduced stops moving at a position beyond the edge receiving section 65. Accordingly, the second and subsequently outputted paper sheets S can be stacked on the first paper sheet S while extending along the first paper sheet S. Thereafter, the subsequently outputted paper sheets S are stacked on the previously outputted paper sheets S. Further, a distance in the width direction between the outer side surfaces 723 is preferably experimentally determined.

Next, the rib 70 corresponding to the case of outputting the A3 size paper sheets S will be described. As shown in FIG. 4, the second receiving section 62 includes a pair of third ribs 73 that form the rib 70. The third rib 73 extends in the output direction D2 from an upstream position to the inclined surface 653, and protrudes in a convex shape from the top surface 62*a*.

The pair of third ribs 73 are symmetrically arranged to the center in the width direction, which is perpendicular to the output direction D2 of the paper sheet S. As with the pair of first ribs 71, the pair of third ribs 73 are symmetrically arranged to the center in the width direction (center line μl), which is perpendicular to the output direction D2 of the paper sheet S.

The third rib 73 is composed of an inclined surface 731, a flat surface 732, an outer side surface 733, and an inner side surface 734. The inclined surface 731 is formed to gradually rise from the top surface 62 in an upstream part of the second receiving section 62. The flat surface 732 extends from a downstream end of the inclined surface 731 to a substantially middle of the inclined surface 653 of the edge receiving section 65 at a predetermined height. The outer side surfaces 733 and the inner side surfaces 734 in the width direction of the pair of third ribs 73 are each gently inclined to the top surface 62*a*.

A distance between the outer side surfaces 733 of the pair of third ribs 73 is set to be smaller than a distance between the outer side surfaces 723 of the pair of second ribs 72. Specifically, the pair of third ribs 73 are formed at positions such that, when the second receiving section 62 is pressed and housed under the first receiving section 61, the pair of third ribs 73 are housed in a pair of groove sections 611, which are formed on the underside of the pair of first ribs 71 provided in the first receiving section 61.

The third rib 73 is mainly used for removing curling of the A3 size paper sheets S. In the following description, curling that occurs in recording of the A3 size paper sheets S will be described. In the present embodiment, since the recording surface (printing surface) of the paper sheet S is on the top side, the "downward curl" occurs as described above. Further, when the paper sheet S is of A3 size, the outputted paper sheet S tends to curl in the length direction, rather than the width direction, while curling downward. This state of curling is hereinafter referred to as "machine-direction curl." More specifically, although the A3 size paper sheet S typically has the cross-direction curl, the machine-direction curl occurs when the "short grain paper" is used for the paper sheet S.

Figure 8:
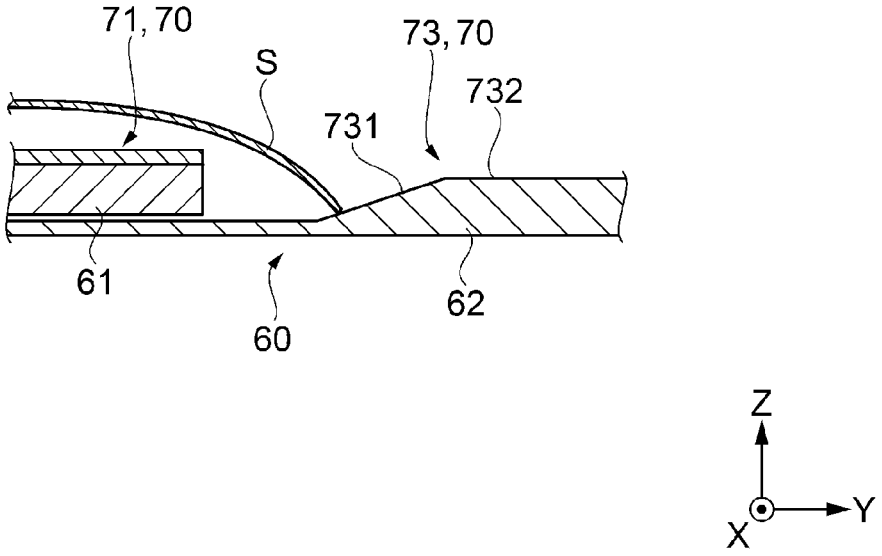
FIG. 8 is a cross-sectional view illustrating how third ribs remove machine-direction curl of an A3 size paper sheet.

FIG. 8 is a cross-sectional view illustrating how the third ribs 73 remove the machine-direction curl of the A3 size paper sheet S. As shown in FIG. 8, in the pair of third ribs 73, when the A3 size paper sheet S having the machine-direction curl is outputted, the downstream edge of the paper sheet S in the length direction is in sliding contact with the respective inclined surfaces 731 of the third ribs 73. The paper sheet S slides on the flat surfaces 732, which are continuous from the inclined surfaces 731, then slides on the inclined surfaces 653 of the edge receiving section 65 at a lower output speed, and finally stops moving at a position beyond the edge receiving section 65. By this operation, the machine-direction curl is removed.

Thus, the first outputted A3 size paper sheet S with the machine-direction curl being reduced stops moving at a position beyond the edge receiving section 65. Accordingly, the second and subsequently outputted paper sheets S can be stacked on the first paper sheet S while extending along the first paper sheet S. Thereafter, the subsequently outputted paper sheets S are stacked on the previously outputted paper sheets S.

According to the present embodiment, the following effects can be obtained.

The recording apparatus 1 of the present embodiment includes the recording head 25 and the output tray 60. The output tray 60 has the rib 70 that receives the outputted paper sheet S. The rib 70 includes a pair of first ribs 71 at upstream positions, each of which is elongated in the output direction D2 and protrudes in a convex shape. Further, the rib 70 includes a pair of second ribs 72 at downstream positions, each of which is elongated in the output direction D2 and protrudes in a convex shape. Further, the output tray 60 has an upstanding end portion 65 formed at a downstream end in the output direction D2, and the second rib 72 is formed to be continuous from the end portion 65. Each of the pair of first ribs 71 and the pair of second ribs 72 are symmetrically arranged to a center in the width direction (center line μl), which is perpendicular to the output direction D2 of the paper sheet S. In the pair of first ribs 71 and the pair of second ribs 72 thus formed, when the paper sheet S is outputted, both ends of the paper sheet S in the width direction are respectively in sliding contact with the outer side surfaces 713 and the outer side surfaces 723 in a substantially symmetrical manner. In particular, since the pair of second ribs 72 are formed continuous to the edge receiving section 65, both ends of the paper sheet S in the width direction can be in sliding contact with the outer side surfaces 723 until they reach the edge receiving section 65 when the paper sheet S is outputted. Accordingly, the cross-direction curl of the A4 size paper sheet S can be removed. Therefore, the stackability in the output tray 60 can be improved.

In the recording apparatus 1 of the present embodiment, the inclined surface 653 is formed on the inner surface of the edge receiving section 65. Further, the pair of second ribs 72 extend from the upstream position relative to the inclined surface 653 to the end portion 652 located downstream relative to the inclined surface 653. The outer side surfaces 723 in the width direction of the symmetrical pair of second ribs 72 are each formed of a vertical surface. Accordingly, the inclined surface 653 prevents the outputted paper sheet S from being ejected forward. Since the outer side surfaces 723 of the symmetrical pair of second ribs 72 are each formed of a vertical surface, the curled ends of the outputted paper sheet S in the width direction can be reliably caught by the outer side surfaces 723 and slidingly guided to the end portion 652 of the inclined surface 653. Accordingly, the cross-direction curl can be further removed. Accordingly, the stackability in the output tray 60 can be further improved.

In the recording apparatus 1 of the present embodiment, the output tray 60 includes the first receiving section 61, and the second receiving section 62 that can be extended from the first receiving section 61. The pair of first ribs 71 are formed in the first receiving section 61, the pair of second ribs 72 and the inclined surface 653 are formed in the second receiving section 62. Accordingly, the output tray 60 can be downsized. Further, by providing the pair of first ribs 71 in the first receiving section 61, and providing the pair of second ribs 72 and the inclined surface 653 in the second receiving section 62, the cross-direction curl can be removed. Accordingly, the stackability in the output tray 60 can be further improved.

In the recording apparatus 1 of the present embodiment, the second receiving section 62 has the pair of third ribs 73 that extend from an upstream position to the inclined surface 653, the pair of third ribs being elongated in the output direction D2 and protruding in a convex shape. The pair of third ribs 73 are symmetrically arranged to a center in the width direction of the outputted paper sheet S, and each of the pair of third ribs 73 have an inclined surface 731 on an upstream end. Accordingly, when the paper sheet S, for example the A3 size paper sheet S, having the machine-direction curl is outputted, the leading edge of the paper sheet S in the output direction D2, which is curled in the machine direction, is allowed to be in contact with the inclined surfaces 731 of the third ribs 73. This causes the paper sheet S to smoothly slide downstream along the third ribs 73. Accordingly, the machine-direction curl can be removed, and thus the stackability in the output tray 60 can be improved.

In the recording apparatus 1 of the present embodiment, the pair of third ribs 73 are respectively inserted into the groove sections 611 of the pair of first ribs 71 when the second receiving section 62 is housed in the first receiving section 61. Accordingly, the output tray 60 can be made thinner.

2. Modified Example 1

In the recording apparatus 1 of the present embodiment, the outer side surfaces 713 of the first ribs 71 and the outer side surfaces 723 of the second ribs 72 are formed of a vertical surface. However, the disclosure is not limited thereto, and a surface slightly inclined to the vertical direction may also be used. In this case, curling can also be removed although the degree of removal is lower than that by the vertical outer side surfaces 713 and 723.

3. Modified Example 2

In the recording apparatus 1 of the present embodiment, the third ribs 73 disposed in the second receiving section 62 are configured to be inserted into the groove sections 611 of the first ribs 71. However, the disclosure is not limited thereto. Any of the pair of first ribs 71, the pair of second ribs 72, and the pair of third ribs 73 may have a configuration movable in the vertical direction so that it can move downward in the housed state to thereby contribute to reduction in thickness of the output tray 60, and move upward in the state extended from the housed state to thereby remove curling.

The following description will be given of the content derived from the above embodiment and modified examples.

A recording apparatus includes: a recording head that performs recording by ejecting liquid onto a medium; and an output tray into which the medium on which recording has been performed is outputted, wherein the output tray has a rib that receives the outputted medium, the rib includes a pair of first ribs disposed at an upstream position, the pair of first ribs being elongated in an output direction and protruding in a convex shape, and a pair of second ribs disposed at a downstream position, the pair of second ribs being elongated in the output direction and protruding in a convex shape, the output tray has an upstanding end portion formed at a downstream end in the output direction, the second rib is formed to be continuous from the end portion, and each of the pair of first ribs and the pair of second ribs are symmetrically arranged to a center in a width direction, which is perpendicular to the output direction of the medium.

With this configuration, when the medium, for example, an A4 size medium, having a cross-direction curl is outputted, both ends of the medium in the width direction, which are curled in the cross-direction, are respectively in sliding contact with the pair of first ribs and the pair of second ribs in a substantially symmetrical manner. Accordingly, curling of the medium can be removed. In particular, since the second ribs are formed continuous to the edge receiving section, both ends of the medium in the width direction can be in sliding contact with the second ribs until they reach the edge receiving section when the medium is outputted. Therefore, the stackability in the output tray can be improved.

In the above recording apparatus, an inclined surface may be formed on an inner surface of the end portion, the pair of second ribs may extend from an upstream position relative to the inclined surface to the end portion located downstream relative to the inclined surface, and the symmetrical pair of second ribs may have outer side surfaces in the width direction, the outer side surfaces extending vertically.

With this configuration, the inclined surface prevents the outputted medium from being ejected forward (in the output direction). Since the outer side surfaces of the symmetrical pair of second ribs are each formed of a vertical surface, the curled ends of the outputted medium in the width direction can be reliably caught by the outer side surfaces and slidingly guided to the end portion of the inclined surface. Accordingly, curling can be further removed. Therefore, the stackability in the output tray can be further improved.

In the above recording apparatus, the output tray may include a first receiving section, and a second receiving section that can be extended from the first receiving section, and the pair of first ribs may be formed in the first receiving section, and the pair of second ribs and the inclined surface may be formed in the second receiving section.

With this configuration, the output tray can be downsized. Further, by providing the pair of first ribs in the first receiving section, and providing the pair of second ribs and the inclined surface in the second receiving section, curling can be removed, and thus the stackability in the output tray can be further improved.

In the above recording apparatus, the second receiving section may have a pair of third ribs that extend from an upstream position to the inclined surface, the pair of third ribs being elongated in the output direction and protruding in a convex shape, and the pair of third ribs may be symmetrically arranged to a center in a width direction of the medium outputted, and each of the pair of third ribs may have an inclined surface on an upstream end.

With this configuration, when the medium, for example the A3 size medium, having the machine-direction curl is outputted, the leading edge of the medium in the output direction, which is curled in the machine direction, is allowed to be in contact with the inclined surfaces of the third ribs. This causes the medium to smoothly slide downstream along the third ribs. Accordingly, the machine-direction curl can be removed. Therefore, the stackability in the output tray can be improved.

In the above recording apparatus, the pair of third ribs may be respectively inserted inside the pair of first ribs when the second receiving section is housed in the first receiving section.

With this configuration, the output tray can be made thinner.

In the above recording apparatus, any one of the pair of first ribs, the pair of second ribs, and the pair of third ribs may be vertically movable.

With this configuration, the ribs can move downward in the housed state to thereby contribute to reduction in thickness of the output tray, and move upward in the state extended from the housed state to thereby form the ribs and remove curling of the medium.

What is claimed is:

1. A recording apparatus comprising:

a recording head that performs recording by ejecting liquid onto a medium; and an output tray into which the medium on which recording has been performed is outputted, wherein the output tray has a pair of first ribs elongated in an output direction and protruding in a convex shape, and a pair of second ribs disposed at a downstream position with respect to the first pair of ribs, the pair of second ribs being elongated in the output direction and protruding in a convex shape, the output tray has an upstanding end portion formed at a downstream end in the output direction, an inclined surface being formed on an inner surface of the upstanding end portion, the inside surface being on an upstream part of the upstanding end portion, and being inclined upwards in the output direction, the pair of second ribs are formed on a top surface of the inclined surface of the upstanding end portion to define an elongated protrusion extending in the output direction along and above the upstanding end portion, and each of the pair of first ribs and the pair of second ribs being symmetrically arranged to a center in a width direction, which is perpendicular to the output direction of the medium, the pair of second ribs extend from an upstream position relative to the inclined surface to the upstanding end portion located downstream relative to the inclined surface, the symmetrical pair of second ribs have outer side surfaces in the width direction, the outer side surfaces extending vertically, the output tray includes a first receiving section, and a second receiving section that can be extended from the first receiving section, and the pair of first ribs are formed in the first receiving section, and the pair of second ribs and the inclined surface are formed in the second receiving section.

2. The recording apparatus according to claim 1, wherein the second receiving section has a pair of third ribs that extend from an upstream position to the inclined surface, the pair of third ribs being elongated in the output direction and protruding in a convex shape, the pair of third ribs are symmetrically arranged to a center in a width direction of the medium outputted, and each of the pair of third ribs have an inclined surface on an upstream end.

3. A recording apparatus comprising:

a recording head that performs recording by ejecting liquid onto a medium; and an output tray into which the medium on which recording has been performed is outputted, wherein the output tray has a pair of first ribs elongated in an output direction and protruding in a convex shape, and a pair of second ribs disposed at a downstream position with respect to the first pair of ribs, the pair of second ribs being elongated in the output direction and protruding in a convex shape, the output tray has an upstanding end portion formed at a downstream end in the output direction, the pair of second ribs are formed to be continuous with a top surface of the upstanding end portion to define an elongated protrusion extending in the output direction along and above the upstanding end portion, each of the pair of first ribs and the pair of second ribs are symmetrically arranged to a center in a width direction, which is perpendicular to the output direction of the medium, an inclined surface is formed on an inner surface of the upstanding end portion, the pair of second ribs extend from an upstream position relative to the inclined surface to the upstanding end portion located downstream relative to the inclined surface, and the symmetrical pair of second ribs have outer side surfaces in the width direction, the outer side surfaces extending vertically, the output tray includes a first receiving section, and a second receiving section that can be extended from the first receiving section, and the pair of first ribs are formed in the first receiving section, and the pair of second ribs and the inclined surface are formed in the second receiving section, the second receiving section has a pair of third ribs that extend from an upstream position to the inclined surface, the pair of third ribs being elongated in the output direction and protruding in a convex shape, the pair of third ribs are symmetrically arranged to a center in a width direction of the medium outputted, each of the pair of third ribs have an inclined surface on an upstream end, and the pair of third ribs are respectively inserted inside the pair of first ribs when the second receiving section is housed in the first receiving section.

* * * * *